US005731136A

United States Patent [19]

Schmuck

[11] Patent Number: 5,731,136

[45] Date of Patent: Mar. 24, 1998

[54] COLOR PHOTOGRAPHIC SILVER HALIDE MATERIAL

[75] Inventor: Arno Schmuck, Leichlingen, Germany

[73] Assignee: Agfa-Gevaert, Germany

[21] Appl. No.: 618,208

[22] Filed: Mar. 19, 1996

[30] Foreign Application Priority Data

Mar. 28, 1995 [DE] Germany ..... 195 11 316.0

[51] Int. Cl.[6] ..... G03C 1/815

[52] U.S. Cl. ..... 430/512; 430/505; 430/517; 430/523

[58] Field of Search ..... 430/512, 523, 430/950, 517, 530, 505

[56] References Cited

U.S. PATENT DOCUMENTS 5,075,206 12/1991 Noda et al. .

FOREIGN PATENT DOCUMENTS 9454833 8/1994 Australia .
0 609 533 8/1994 European Pat. Off. .

OTHER PUBLICATIONS

Industrial Inorganic Pigments, Gunter Buxbaum, Weinheim, New York, pp. 227–228.

*Primary Examiner*—Thorl Chea
*Attorney, Agent, or Firm*—Connolly & Hutz

[57] ABSTRACT

$TiO_2$ with an average primary particle diameter of 10 to 100 nm is suitable as a UV absorber for photographic materials.

6 Claims, No Drawings

COLOR PHOTOGRAPHIC SILVER HALIDE MATERIAL

Colour photographic materials always contain UV absorbers in order to improve or maintain the light-stability of the imaging dyes which are present in the material after processing. Daylight rich in UV light can bleach out the imaging dyes.

Examples of the compounds which are usually used in photographic materials for the absorption of UV light include aryl-substituted benzotriazole compounds (U.S. Pat. No. 3,533,794, DE 42 29 233), 4-thiazolidone compounds (U.S. Pat. No. 3,314,794, U.S. Pat. No. 3,352,681), benzophenone compounds (JP-A-2784/71), cinnamic acid esters (U.S. Pat. No. 3,705,805, U.S. Pat. No. 3,707,375), butadiene compounds (U.S. Pat. No. 4,045,229), benzoxazole compounds (U.S. Pat. No. 3,700,455), aryl-substituted triazine compounds (DE 21 13 833, EP 520 938,EP 530 135, EP 531 258) and benzoylthiophene compounds (GB 973 919, EP 521 823). UV-absorbing couplers, or polymers which can be fixed in a special layer by steeping in mordant, are also used.

A disadvantage of these organic compounds is that they are only light-stable to a limited extent themselves. If the UV-absorbing compounds are destroyed by light, the imaging dyes start to bleach out.

The object of this invention was to provide UV-absorbing substances which are suitable for the long-term protection of photographic materials.

It has now been found that this object can be achieved using $TiO_2$ pigments, the average primary particle diameter of which is 10 to 100 nm, preferably 15 to 30 nm. These $TiO_2$ pigments are transparent and exhibit scarcely any light-scattering properties compared with conventional white pigments based on $TiO_2$ (rutile and anatase), which have an optimum particle size of about 0.2 μm. In addition, they are colourless, particularly when the content of other metal oxides is as low as possible, and is less than 5% by weight, preferably less than 2% by weight.

The $TiO_2$ pigments according to the invention are particularly advantageous if more than 80% of the primary particles have a diameter less than 100 nm.

Transparent $TiO_2$ pigments with the cited properties are known from Gunter Buxbaum, Industrial Inorganic Pigments, VCH Weinheim, New York, Basle, Cambridge, Tokyo (1993), pages 227 to 228, for example.

The $TiO_2$ pigments according to the invention are preferably used in the photographic material in a layer which is no further from the light source than is the layer in which the dye formed by development and which is to be protected from UV is situated.

The $TiO_2$ pigments according to the invention are preferably used in a layer which is disposed nearer to the light source than is the layer containing the dye to be protected.

In particular, the $TiO_2$ pigments according to the invention are used in an amount of 0.3 mg to 5 g/m$^2$, preferably 30 mg to 3 g/m$^2$ of photographic material.

It is particularly advantageous if the $TiO_2$ pigments according to the invention are dispersed in a gelatine solution and can thus be cast to form a layer. This results in the obtainment of a layer which is considerably the inner than when using conventional UV absorbers, which are usually dispersed in high-boiling organic solvents and thus have to be emulsified as fine droplets in a gelatine solution.

The $TiO_2$ pigments according to the invention impart a lasting protection to the dyes obtained after photographic development, because they are not destroyed by UV light, in contrast to organic UV absorbers.

The $TiO_2$ pigments according to the invention are preferably added to colour photographic print materials, namely photographic paper and transparent colour photographic film for display purposes.

The photographic materials consist of a support and at least one light-sensitive silver halide emulsion layer. Suitable supports are disclosed in Research Disclosure 37254, Part 1 (1995) p. 285.

Color photographic materials comprise usually at least a red-sensitive, at least a green-sensitive and at least a blue-sensitive silver halide emulsion layer optionally together with intermediate layers and protective layers.

Color photographic negative films and reversal films contain in the following sequence on the support 2 or 3 red-sensitive, cyan coupling, 2 or 3 green-sensitive, magenta coupling and 2 or 3 blue-sensitive, yellow coupling silver halide emulsion layers. The layers of the same spectral sensitivity are distinguished by their photographic speed; lower sensitive layers are usually arranged closer to the support than higher sensitive layers.

There is usually a yellow filter layer between the green- and the blue-sensitive layers to prevent blue light to reach the layers closer to the support than the yellow filter layer.

The possibilities of different layer arrangements and their influence on photographic properties are described in J. Inf. Rec. Mats., 1994, Vol. 22, p. 183–193.

Color photographic paper which is usually less light sensitive than color photographic film contains usually the following sequence of layers on a support: a blue-sensitive, a yellow coupler containing, a green-sensitive, a magenta coupler containing and a red-sensitive, a cyan coupler containing silver halide emulsion layer; the yellow filter layer can be omitted.

To obtain certain results number and arrangements of the light-sensitive layers can be changed. E.g. all high-sensitive layers can be combined to a layer unit and all low-sensitive layers can be combined to a layer unit in a color photographic film to enhance the speed (DE 2 530 645).

Essential constituents of the photographic emulsion layers are the binder, silver halide grains and color couplers.

Information concerning suitable binders is disclosed in Research Disclosure 37254, Part 2 (1995), p. 286.

Information concerning suitable silver halide emulsions, their production, ripening stabilisation and spectral sensitisation together with suitable spectral sensitising dyestuffs is disclosed in Research Disclosure 37254, Part 3 (1995), p. 286 and in Research Disclosure 37038, Teil XV (1995), p. 89.

Photograhic materials with a suitable speed for picture taking with a camera contain usually silver bromide iodide emulsions which may contain small amounts of silver chloride. Photograhic print materials contain either silver chloride bromide emulsions with up to 80 mol-% of AgBr or silver chloride bromide emulsions with more than 95 mol-% of AgCl.

Information concerning color couplers is disclosed in Research Disclosure 37254, Part 4 (1995), p. 288 and in Research Disclosure 37038, Part II (1995), p. 80. The maximum absorption of the dyestuffs produced from the color couplers and the oxidation product of the color developer are preferably within the following ranges:

Yellow 430 to 460 nm

Magenta 540 to 560 nm

Cyan 630 to 700 nm

To improve speed, graininess, sharpness and color separation compounds are frequently used in color photographic films which by reaction with the oxidation product of the color developer release other compounds which influence the photographic results, e.g. DIR-couplers which release a development inhibitor.

Information concerning such compounds, predominantly couplers is disclosed in Research Disclosure 37254, Part 5 (1995), p. 290 and in Research Disclosure 37038, Part XIV (1995), p. 86.

The color couplers and other components of the layers which are usually hydrophobic, are preferably dissolved or dispersed in high boiling organic solvents. The resulting solutions or dispersions are then emulsified in an aqueous solution of a binder, usually in a gelatine solution.

After drying, the solutions or dispersions with the high boiling organic solvents are distributed in the layers as fine droplets with a diameter of from 0.05 to 0.8 nm.

Suitable high boiling organic solvents, methods to introduce the solutions with said solvents into the layers of a photographic materials and further methods how to introduce chemical compounds into photographic layers are disclosed in Research Disclosure 37254, Part 6 (1995), p. 292.

The interlayers between layers of different spectral sensitivity may contain agents which prevent undesired diffusion of the oxidation product of the developer from a light-sensitive layer into another light-sensitive layer of different spectral sensitivity.

Suitable compounds for this purpose (white couplers, scavengers) are disclosed in Research Disclosure 37254, Part 7 (1995), p. 292 and in Research Disclosure 37038, Part III (1995), p. 84.

The photographic material may contain additionally other UV-absorbers, optical whiteners, spacers, filter dyes, formalin scavengers, light stabilisers, anti-oxidants, $D_{min}$-dyes, additives to improve the stability of dyes, couplers and whites and to reduce color fogging, plasticers (latices), biocides and others.

Suitable compounds are disclosed in Research Disclosure 37254, Part 8 (1995), p. 292 and in Research Disclosure 37038, Parts IV, V, VI, VII, X, XI and XII (1995), p. 84.

The layers of the photographic material are usually hardened. Suitable hardening agents are disclosed in Research Disclosure 37254, Part 9 (1995), p. 294 and in Research Disclosure 37038, part XII (1995), p. 86.

The color photographic material is processed after imagewise exposure. Details of the different processing methods and the chemical substances necessity therefore are disclosed in Research Disclosure 37254, Part 10 (1995), p. 294 and in Research Disclosure 37038, parts XVI to XXIII (1995), page 95.

EXAMPLE 1 (COMPARISON)

A colour photographic recording material was prepared by depositing the following layers in the cited sequence on a film base comprising paper coated on both sides with polyethylene. The mounts cited relate to 1 $m^2$ in each case. The corresponding mounts of $AgNO_3$ are given for the deposition of silver halide.

1st layer (substrate layer):

0.1 g gelatine

2nd layer (blue-sensitive layer):

blue-sensitised silver halide emulsion (99.5 mole % chloride, 0.5 mole % bromide, average particle size 0.9 μm) comprising 0.5 g $AgNO_3$ with 1.25 g gelatine 0.42 g yellow coupler GB-1

0.18 g yellow coupler GB-2

0.05 g tricresyl phosphate (TCP)

0.10 g stabiliser ST-1

0.30 mg stabiliser ST-2

0.70 mg sensitiser S-1

3rd layer (intermediate layer):

1.1 g gelatine 0.06 g Oxform scavenger O-1

0.06 g Oxform scavenger O-2

0.12 g TCP

4th layer (green-sensitive layer):

green-sensitised silver halide emulsion (99.5 mole % chloride, 0.5 mole % bromide, average particle size 0.47 μm) comprising 0.40 g $AgNO_3$ with 0.77 g gelatine 0.41 g magenta coupler PP-1

0.06 g stabiliser ST-3

0.50 mg stabiliser ST-4

0.12 g O-2

0.34 g dibutyl phthalate 0.70 mg sensitiser S-2

5th layer (UV protection layer):

1.15 g gelatine 0.50 g UV absorber UV-1

0.10 g UV absorber UV-2

0.03 g O-1

0.03 g O-2

0.35 g TCP

6th layer (red-sensitive layer):

red-sensitised silver halide emulsion (99.5 mole % chloride, 0.5 mole % bromide, average particle size 0.50 μm) comprising 0.30 g $AgNO_3$ with 1.00 g gelatine 0.46 g cyan coupler BG-1

0.46 g TCP 0.60 mg stabiliser ST-5

0.03 mg sensitiser S-3

7th layer (UV protection layer):

0.35 g gelatine 0.15 g UV-1

0.03 g UV-2

0.09 g TCP

8th layer (protective layer):

0.9 g gelatine 0.3 g hardener H-1

0.05 g optical brightener W-1

0.07 g polyvinylpyrrolidone 1.2 mg silicone oil 2.5 mg polymethyl methacrylate spacer GB-1
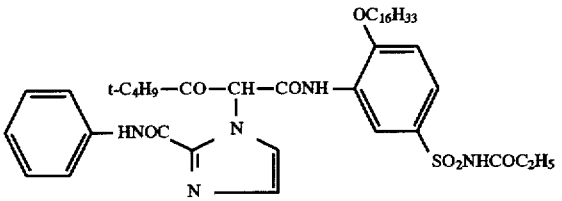
GB-2
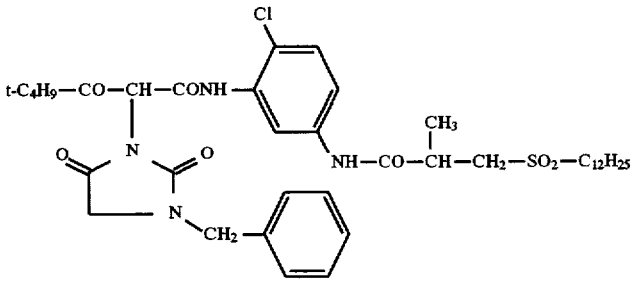
PP-1
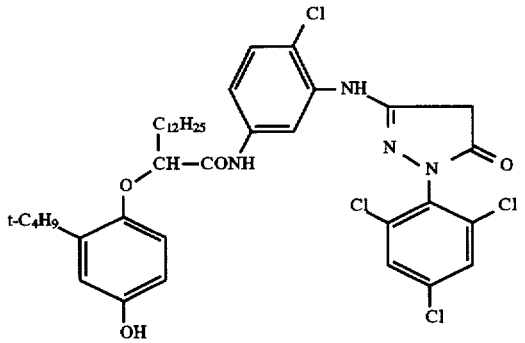
BG-1
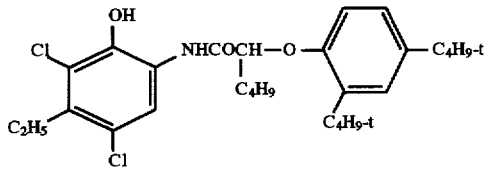
UV-1
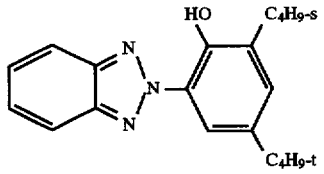
UV-2
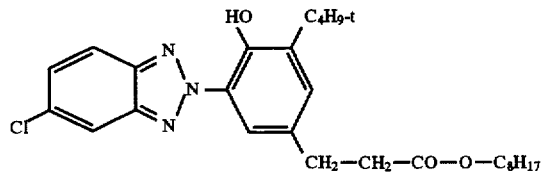
H-1
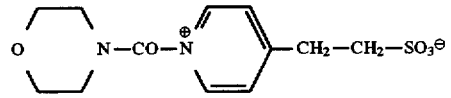
S-1
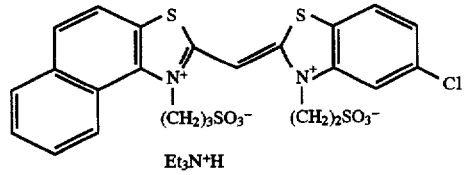

-continued
S-2
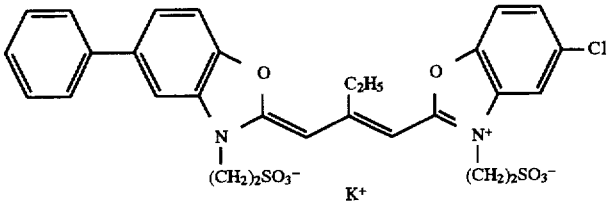
S-3
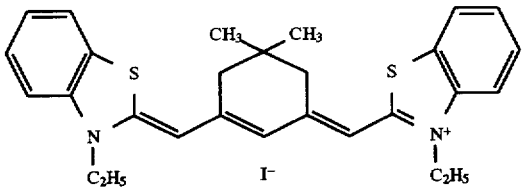
St-1
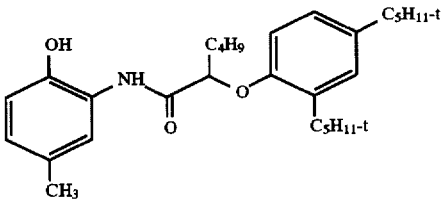
St-2
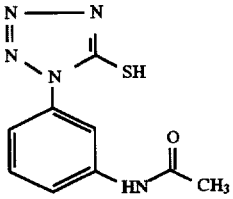
ST-3
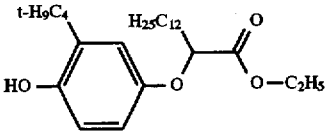
ST-4
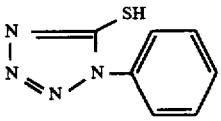
ST-5
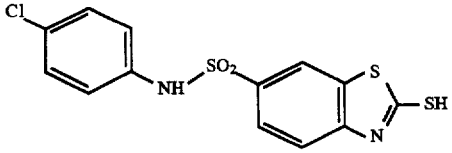
O-1
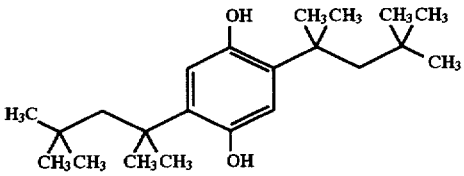
O-2
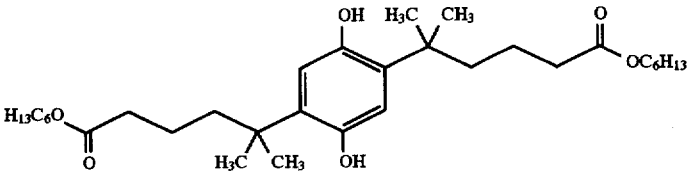

-continued

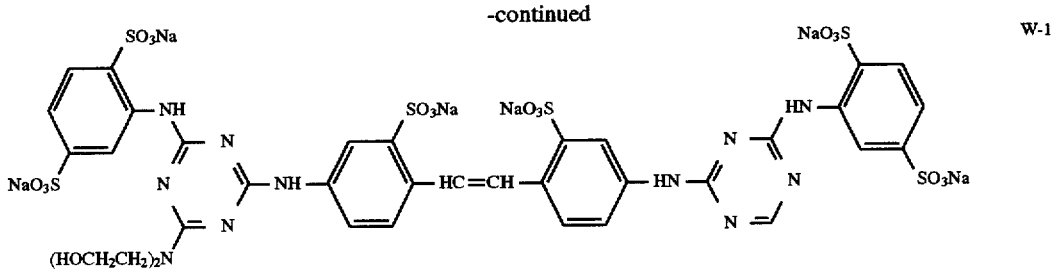

W-1

EXAMPLE 2 (ACCORDING TO THE INVENTION)

This differed as follows from the comparison material:

a) UV-1 and UV-2 were omitted in the 5th layer.

b) the 7th layer had the following composition:

0.30 g gelatine 0.25 g $TiO_2$ (particle size about 30 nm, density 3.8 g/cm$^3$)

The colour photographic recording materials were exposed through a step wedge. In the course of this procedure, additional falters were placed in the beam path of the exposure unit, so that the wedge appeared neutral at an optical density of D=0.6. In addition, the material was exposed through a step wedge using a filter for red light, green light and blue light in each case, so that a cyan, magenta and yellow colour separation was obtained. The exposed material was processed as follows:

| Step | Time | Temperature |
|---|---|---|
| Developing | 45 sec | 35° C. |
| Bleachfix | 45 sec | 35° C. |
| Washing | 90 sec | 33° C. |

The processing baths were prepared according to the following specification:

| Colour developer solution | |
|---|---|
| tetraethylene glycol | 20.0 g |
| N,N-diethylhydroxylamine | 4.0 g |
| (N-ethyl-N-(2-methanesulphonamido)ethyl)-4-amino-3-methylbenzene sulphate | 5.0 g |
| potassium sulphite | 0.2 g |
| potassium carbonate | 30.0 g |
| polymaleic anhydride | 2.5 g |
| hydroxyethanediphosphonic acid | 0.2 g |
| optical brightener (4,4'-diaminostilbene-sulphonic acid derivative) | 2.0 g |
| potassium bromide | 0.02 g |
| made up to 1 liter with water; | |
| pH adjusted to pH 10.2 with KOH or $H_2SO_4$. | |

-continued

| Bleachfix solution | |
|---|---|
| Ammonium thiosulphate | 75.0 g |
| sodium hydrogen sulphite | 13.5 g |
| ethylenediaminetetraacetic acid (iron ammonium salt) | 45.0 g |
| made up to 1 liter with water; | |
| pH adjusted to pH 6.0 with ammonia or acetic acid. | |

After processing, the neutral and colour separation wedges were exposed to radiation of 9.6 million Lxh, 14.4 million Lxh and 24 million Lxh from a xenon arc lamp, and the changes in density in % were measured at densities of 0.3, 0.6, 1.0 and 1.4 via fogging.

Results: see Table 1. The examples 2a–2f show the better light-stability obtained overall, particularly at high radiation dosages (24 million Lxh).

TABLE 1

| | Duration of exposure to radiation | Yellow Change in density [%] at density | | | | Magenta Change in density [%] at density | | | | Cyan Change in density [%] at density | | | |
|---|---|---|---|---|---|---|---|---|---|---|---|---|---|
| Example | [million L × h] | 0.3 | 0.6 | 1.0 | 1.4 | 0.3 | 0.6 | 1.0 | 1.4 | 0.3 | 0.6 | 1.0 | 1.4 |
| 1 a | 9.6 | −29 | −18 | −12 | −11 | −39 | −24 | −15 | −11 | −36 | −23 | −14 | −12 |
| 1 b | 9.6 | −42 | −23 | −19 | — | −56 | −35 | −21 | — | −44 | −31 | −25 | −22 |
| 1 c | 14.4 | −44 | −32 | −24 | −21 | −55 | −36 | −24 | −20 | −55 | −38 | −27 | −21 |
| 1 d | 14.4 | −65 | −44 | −33 | −34 | −73 | −51 | −34 | −24 | −60 | −51 | −41 | −37 |
| 1 c | 24.0 | −57 | −48 | −40 | −35 | −76 | −58 | −41 | −32 | −79 | −61 | −44 | −36 |
| 1 f | 24.0 | −86 | −70 | −56 | −54 | −88 | −78 | −64 | −50 | −88 | −75 | −63 | −54 |
| 2 a | 9.6 | −26 | −13 | −8 | −7 | −25 | −16 | −10 | −8 | −20 | −12 | −8 | −7 |
| 2 b | 9.6 | −30 | −16 | −14 | — | −33 | −21 | −12 | — | −22 | −16 | −12 | −11 |
| 2 c | 14.4 | −39 | −21 | −15 | −11 | −35 | −24 | −15 | −12 | −31 | −17 | −11 | −9 |
| 2 d | 14.4 | −45 | −30 | −24 | −19 | −42 | −31 | −19 | −13 | −30 | −26 | −21 | −18 |
| 2 c | 24.0 | −46 | −29 | −23 | −18 | −45 | −33 | −23 | −18 | −42 | −27 | −19 | −15 |
| 2 f | 24.0 | −52 | −41 | −33 | −26- | −49 | −43 | −27 | −23 | −39 | −35 | −29 | −22 |

1 a, 1 c, 1 e, 2 a, 2 c and 2 e are for neutral wedges; the remainder are for colour separation wedges.

I claim:

1. A color photographic silver halide material which comprises a support, a first layer, a second layer a third layer, and a fourth layer is UV protective layer, with the first layer on said support being a blue sensitive layer containing a yellow coupler, the second layer on said first layer, being a green sensitive layer containing a magenta coupler, the third layer on said second layer, being a red sensitive layer containing a cyan coupler and said fourth layer contains a titanium dioxide pigment with an average primary particle diameter of 10 to 100 nm.

2. The color photographic silver halide material according to claim 1, wherein the titanium dioxide pigment has an average primary particle diameter of 15 to 30 nm.

3. The color photographic silver halide material according to claim 1, wherein the titanium dioxide pigment is used in an amount of 0.3 mg to 5 $mg/m^2$ of photographic material.

4. The color photographic silver halide material as claimed in claim 1, wherein said titanium dioxide pigment is transparent and exhibit barely any light-scattering properties compared with white pigments based on titanium dioxide, which has an optimum particle size of about 0.2 μm.

5. The color photographic silver halide material as claimed in claim 1, wherein more than 80% of the primary particles have a diameter less than 100 nm.

6. The color photographic silver halide material according to claim 1, wherein a yellow filter layer is omitted.

* * * * *